United States Patent [19]

Shimada et al.

[11] Patent Number: 4,465,386

[45] Date of Patent: Aug. 14, 1984

[54] IMPACT TYPE DOT PRINTER

[75] Inventors: Tatsuo Shimada; Yoshinori Chida; Satoru Tada, all of Tokyo, Japan

[73] Assignee: Seikosha Co., Ltd., Tokyo, Japan

[21] Appl. No.: 183,922

[22] Filed: Sep. 3, 1980

[30] Foreign Application Priority Data

Sep. 17, 1979 [JP] Japan ..... 54-119506
Jun. 30, 1980 [JP] Japan ..... 55-88937

[51] Int. Cl.[3] ..... B41J 3/02
[52] U.S. Cl. ..... 400/121; 101/93.04
[58] Field of Search ..... 400/121, 158, 158.1, 400/159, 655; 178/4, 25; 101/93.04, 93.15, 93.16, 93.17

[56] References Cited

U.S. PATENT DOCUMENTS

| | | | |
|---|---|---|---|
| 3,324,240 | 6/1967 | Kleinschmidt et al. | 101/93.04 X |
| 3,804,008 | 4/1974 | Hoyer | 101/93.04 |
| 3,834,304 | 9/1974 | Potter | 101/93.04 |
| 3,926,293 | 12/1975 | Ljungberg | 101/93.16 X |
| 4,077,336 | 3/1978 | Talvard et al. | 101/93.05 |
| 4,202,638 | 5/1980 | Stenudd | 400/124 |

*Primary Examiner*—Paul T. Sewell
*Attorney, Agent, or Firm*—Robert E. Burns; Emmanuel J. Lobato; Bruce L. Adams

[57] ABSTRACT

A printing head adapted to be moved for scanning in a direction perpendicular to the direction of feed of a paper is provided with a sole printing element (printing hammer) adapted to be driven in an impacting manner by an electromagnetic driving device. A platen disposed to oppose to the printing head is provided with a plurality of projections formed on the outer peripheral surface thereof and extending substantially in parallel with the axis thereof. Each of the projections being adapted to oppose to the printing element in a crossing relation to the latter when it is brought to the position ahead of the printing element as a result of rotation of the platen. As the printing element collides with the projection while the platen is rotated, a dot is formed on the recording paper at the position of crossing between the printing element and the projection, so that various patterns such as letters, numerals, symbols, pictures and so forth are printed at a high speed by a sole printing element.

3 Claims, 13 Drawing Figures

DATA
CHARACTER GENERATOR
30
SHIFT REGISTER
31
BUFFER CIRCUIT
33
DRIVER CIRCUIT
34
MOVING COIL
15
COUNTER
35
DELAY CIRCUIT
44
DELAY CIRCUIT
43
DELAY CIRCUIT
42
DELAY CIRCUIT
45
COLUMN ADDRESS COUNTER
32
36
37
38
39
40
41
46
47
Tc
Te
Tb

IMPACT TYPE DOT PRINTER

BACKGROUND OF THE INVENTION

The present invention relates to an impact type dot printer and, more particularly, to a novel impact type dot printer capable of forming letters, numerals, symbols, pictures, graphs and so forth at a high speed by means of a single printing element.

The impact type dot printer has various advantages. Namely, it is possible to form letters, graphs and so forth at a high printing speed. In addition, printing can be made on a multiplicity of papers by the use of non-carbon copying papers. The most commonly used impact type dot printer is the wire printer which has 7 (seven) or more printing wires the ends of which are arrayed in a row in the direction of feed of the paper. This wire printer, however, has a complicated construction and requires a large number of parts. In addition, the weight of the printing head is considerably large, and a scanning mechanism and circuit power source matching such a heavy head is required.

Another known impact type dot printer is the helical platen type dot printer which may seem to resemble the dot printer of the present invention. This helical platen type printer incorporates a platen (rotary drum) having one or more helical projections formed on the peripheral surface thereof, and a cross bar hammer disposed to oppose the platen along the length of the latter so as to strike the projections. In this helical platen type dot printer, the cross bar hammer is formed linearly to extend along the axis of the platen and is adapted to strike the helical projections without being scanned in the direction perpendicular to the direction of feed of the recording paper. Therefore, for forming a letter constituted by a dot matrix of 7 rows and 5 columns, for instance, 7 increments of paper feed are necessary for each character row. Thus, the printing speed is impractically low. In addition, since the position of collision (intersection) between the cross bar hammer and the helical projections of the platen moves progressively in the lateral direction as the platen rotates, the cross bar hammer makes an innegligibly large twisting distortion when it collides with the helical projection on the end portion of the platen. As a consequence, the operation is rendered unstable. In addition, there is a practical limit in the length of the cross bar hammer, i.e. the number of characters which can be printed by a sole cross bar hammer. For increasing the number of characters per line, it is necessary to incorporate a plurality of cross bar hammers.

SUMMARY OF THE INVENTION

The present invention provides an impact type dot printer in which the printing head carries only one printing element, and a platen opposing the printing head is provided on its outer peripheral surface with a plurality of projections arranged in rows substantially parallel to the axis thereof, each projection being adapted to cross and oppose the printing element at a position ahead of the printing element.

It is an object of the invention to provide a novel impact type dot printer which has a reduced size and weight and which can be produced at a low cost.

It is another object of the invention to provide an impact type dot printer capable of printing at a high speed various characters such as letters, numerals and symbols, as well as graphs and pictures.

It is still another object of the invention to provide an impact type dot printer which can be driven with a reduced power consumption.

DESCRIPTION OF THE PREFERRED EMBODIMENTS

An impact type dot printer of a first embodiment of the invention will be described hereinunder with reference to FIGS. 1 to 7.

Figure 1:
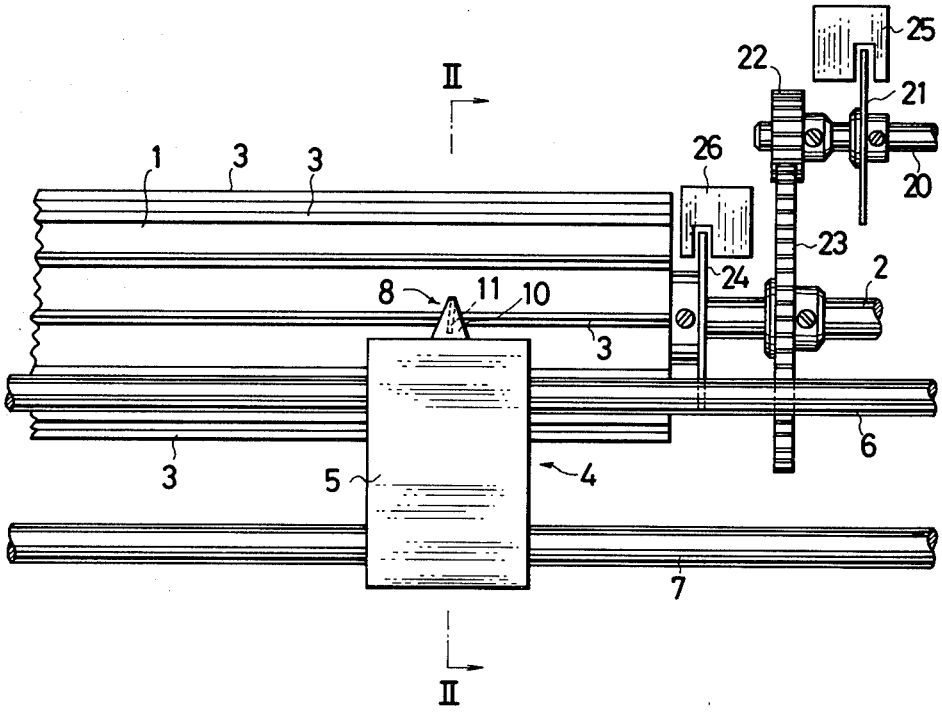
FIG. 1 is a schematic front elevational view of an impact type dot printer constructed in accordance with an embodiment of the invention.
Figure 2:
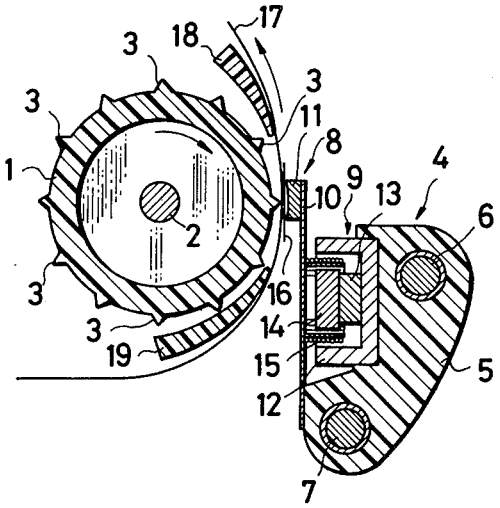
FIG. 2 is a sectional view taken along the line II—II of FIG. 1.

Referring first to FIGS. 1 and 2, a drum-shaped platen 1 is fixed to a platen shaft 2 and is adapted to be rotated substantially continuously in the clockwise direction as viewed in FIG. 2. In this embodiment, the platen 1 has a length substantially corresponding to the lateral breadth of a recording paper 17. A plurality of rows (12 rows in the illustrated embodiment) of projections 3, each row extending substantially in parallel to the axis of the platen, are formed on the outer periphery of the platen 1. A printing head 4 is disposed to oppose to the platen 1 so as to move in the axial direction of the platen 1, i.e. in the direction perpendicular to the direction of feed of a paper 17, at a position ahead of the platen 1.

A carriage 5 carrying the printing head 4 is made of a light-weight non-magnetic material and is slidably supported by guide shafts 6,7. A printing hammer 8 is for forming dots on the recording paper 17 in cooperation with the projections 3 of the platen, upon collision with the projections when driven by an electromagnetic driving device 9 provided at the rear side of the carriage 5.

In the illustrated embodiment, the printing hammer 8 and the electromagnetic device 9 have, not exclusively, the following constructions. The printing hammer 8 is composed of a cantilevered leaf spring 10 cantilevered at its lower end to the carriage 5, and a striking member 11 fixed to the upper end of the leaf spring 10. The striking member 11 extends substantially in the same direction as the direction of feed of the printing paper 17 so as to cross and oppose to one of the projection 3 positioned ahead of the striking member, and has a length which is only slightly taller than the height of the letters to be printed.

The electromagnetic driving device 9 includes an outer magnet pole 12 in the form of a bottom-equipped cylinder. a strong rare earth permanent magnet 13 such as a samarium cobalt and fixed to the bottom of the outer magnet pole 12, an inner magnet pole 14 fixed to the front side of the permanent magnet 13 and a moving coil 15 fixed to the leaf spring 10 and disposed in the magnetic gap between the outer and inner magnetic poles 12,14. An ink ribbon 16 extends ahead of the striking member 11 of the printing hammer 8. The recording paper 17 is fed in the direction of arrow in FIG. 2 through the gap between the ink ribbon 16 and the platen 1, while being guided by the paper guides 18,19.

Figure 3:
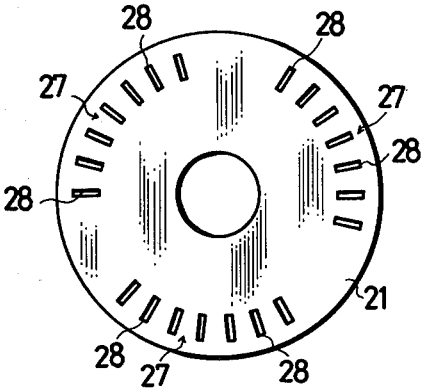
FIG. 3 is an enlarged front elevational view of a slit disc for row detection.
Figure 4:
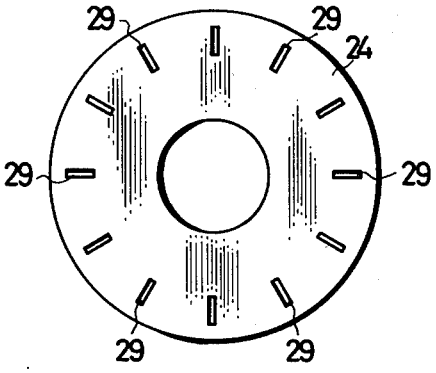
FIG. 4 is an enlarged front elevational view of a slit disc for column detection.

Referring further to FIG. 1, a rotary shaft 20 is adapted to be rotatively driven by a motor (not shown). The rotary shaft 20 carries a slit disc 21 and a pinion 22. The pinion 22 meshes with a gear 23 fixed to the platen shaft 2 which in turn carries a slit disc 24. Each of detectors 25,26 has a light-emitting element and a light-receiving element which are arranged to oppose each other at its opening portion which receive the peripheries of the slit discs 21 and 24. As shown in FIG. 3, the slit disc 21 is provided in its periphery with several groups (three groups in the illustrated embodiment) of slits 27, each group having a plurality of slits 28 arranged at a constant pitch. The number of slits 28 in each group 27 corresponds to the number of rows M of a character of M-rows N-column dot matrix. In the illustrated embodiment, the number of the slits 28 in each group is 7. On the other hand, the slit disc 24 is provided in its periphery with a plurality of slits 29 formed at a constant pitch, as shown in FIG. 4. The number of the slits 29 corresponds to the number of the projections 3 of the platen 1 which is, in this case, 12.

These detectors 25,26 are adapted to produce a row detect signal b and a column detect signal c as shown in FIGS. 6B and 6A, respectively.

The arrangement is such that the slit disc 24 makes a 30° rotation while the slit disc 21 makes a 120° rotation, so that both detectors produce pulses at a ratio of pulse number of 7:1. Therefore, in this embodiment, the reduction ratio between the pinion 22 and the gear 23 is selected to be $\frac{1}{4}$. The row detect signal b is a signal having one cycle constituted by seven equi-spaced row detect pulses $Pb_1, Pb_2 \ldots P_{b7}$. The row positions of the dots are determined by respective row detect pulses $Pb_1$, $Pb_2 \ldots Pb_7$. Namely, it is arranged such that the row detect pulses $Pb_1$, $Pb_2 \ldots Pb_7$ are generated when the projection 3 of the platen 1 as shown in FIG. 2 is brought to the rotational positions of first, second, . . . seventh lines. The column detect signal c is for detecting the number of the columns of the dot matrix. It is arranged such that each column detect signal Pc is produced just before the generation of the row detect pulse $Pb_1$.

The printing head 4 is adapted to be moved for scanning along the guide shafts 6,7 by means of a suitable driving device (not shown). The speed of movement of the printing head 4 during the printing operation, i.e. the speed when the printing head 4 is moved for the scanning from the start position (not shown) to the right, is related to the rotation speed of the platen 1, such that the printing head 4 moves a distance corresponding to N dot columns as the platen 1 makes a $\frac{1}{2}$ rotation.

Figure 7:
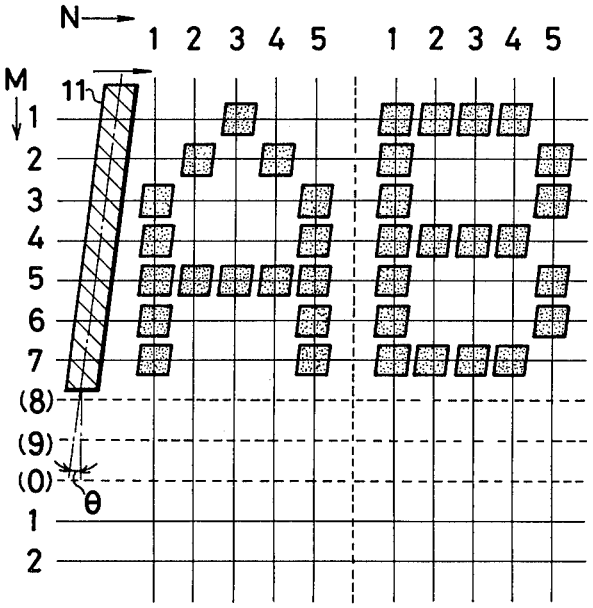
FIG. 7 is an enlarged sectional view showing letters formed by the printer together with a striking member.

As shown in FIG. 7, the striking member 11 of the printing hammer 8 has a length at least corresponding to the height of characters to be printed, and is inclined at an angle $\theta$ to the direction of feed of the paper.

The angle $\theta$ of inclination of the striking member 11 is determined in relation to the scanning speed of the printing head 4. In the illustrated embodiment, this inclination angle $\theta$ is selected to be about 7° to 8°. The reason why the striking member 11 is inclined will be fully understood from a description which will be given later.

Figure 5:
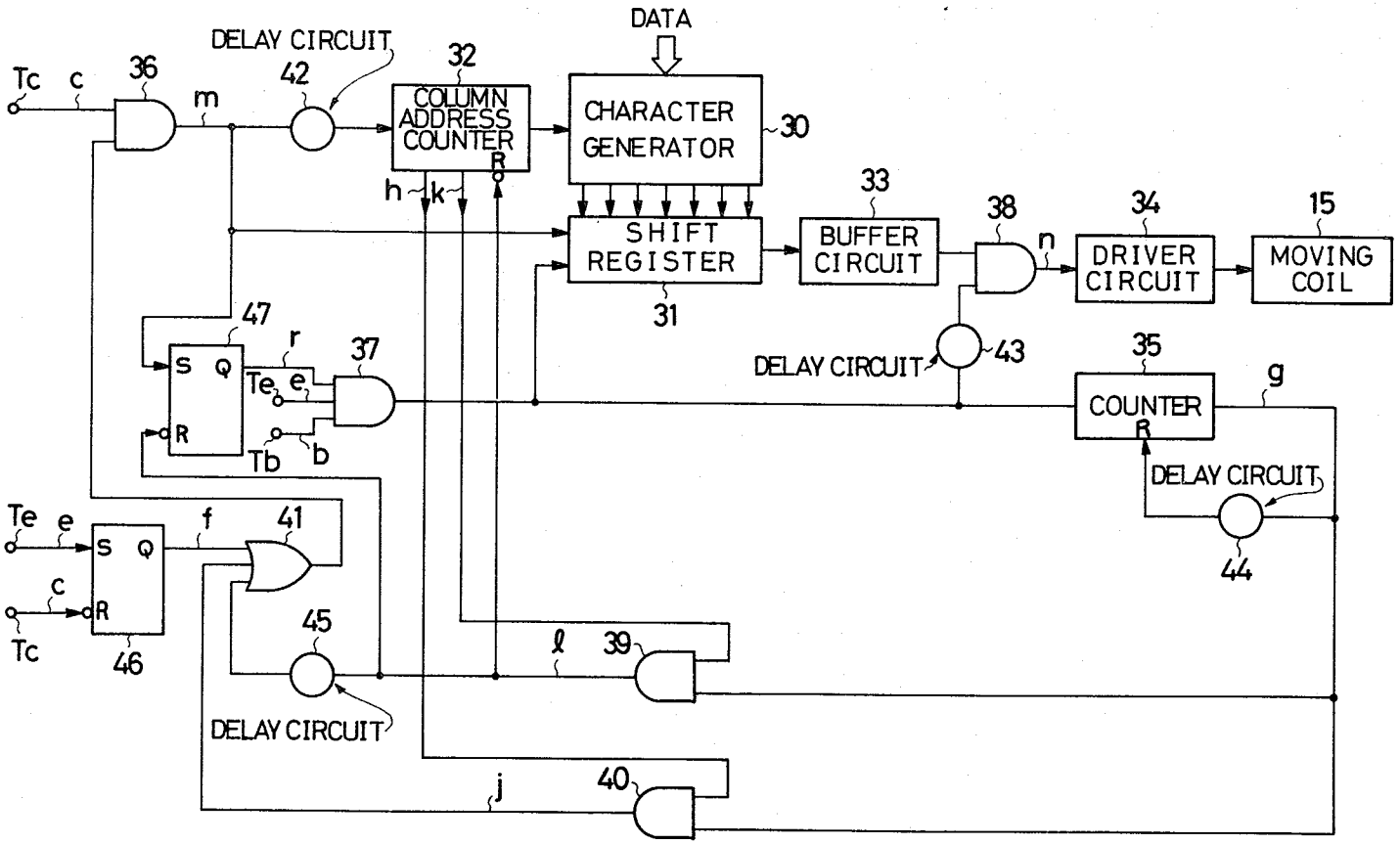
FIG. 5 is a diagram of a driving control circuit to which a moving coil is connected.

The moving coil 15 shown in FIG. 2 is connected to the driving control circuit which is shown, by way of an example, in FIG. 5. This driving control circuit includes a character generator 30, shift register 31, column-address counter 32, buffer circuit 33, driver circuit 34, counter 35, AND gates 36,37,38,39,40, OR gate 41, delay circuits 42,43,44,45 and flip-flop circuits 46,47. The column address counter 32 is adapted to produce an output signal S corresponding to the counted number, and the column of the character generator 30 is appointed by the output signal S. The column address counter 32 produce also the output signals h and k.

The output signals h and k take the logical values of "1" and "0" until the number N of the dot matrix columns, i.e. 5, is counted. As the number of the columns is counted, the logical values of these signals are inverted to "0" and "1", respectively. The logical value of the counter 35 is inversed from "0" to "1" as the number of rows M of the dot matrix, i.e. 7, is counted and is reset to "0" after a delay time which is determined by means of the delay circuit 44.

Referring to FIG. 5, a terminal Tb is connected to a detector 25 shown in FIG. 1, while a terminal Tc is connected to the detector 26 shown in FIG. 1. A terminal Te is adapted to receive a printing start position detect signal e as shown in FIG. 6E. The flip-flop circuit 46 is adapted to be set by the rise of the above-mentioned printing start position detect signal e, and is reset by the fall of the column detect signal c. The flip flop 47 is set and reset by the rise of a signal m from the AND gate 36 and by the fall of the signal l from the AND gate 39.

The printing operation of this printer will be described hereinunder.

The printing head 4 is located at the right-side end of the platen 1 as viewed in FIG. 1. The printing operation is performed in the following manner as the printing head 4 is moved from the start position at the left-side end of the platen 1 to the right. First of all, the platen driving motor is started by the start signal a shown in FIG. 6A, so that the drive shaft 20 shown in FIG. 1 is rotated and, further, the platen shaft 2 is rotated through the medium of the pinion 22 and the gear 23, so that the platen 1 is rotated continuously in the clockwise direction (direction of arrow) as viewed in FIG. 2, at a predetermined rotation speed. As a result, the detectors 25 and 26 start to produce row detect signals b and the column detect signals c in accordance with the slit discs 21,24 (See FIGS. 3 and 4), as shown in FIGS. 6B and 6C.

Then, as the printing head scanning drive signal d is generated as shown in FIG. 6D, the printing head 4 starts to scan from the start position to the right, through the action of the scanning driving means. As the printing head runs a predetermined distance from the start position, the printing start position detect signal e is produced as shown in FIG. 6E through a sensor which is not shown. As a consequence, the flip-flop 46 shown in FIG. 5 is set by the printing start position detect signal e, so that the output f from the former is inverted to "1" as shown in FIG. 6F. This output signal f is supplied to one of the input terminals of the AND gate 36 through the OR gate 41, and thus the AND gate 36 is opened.

Figure 6:
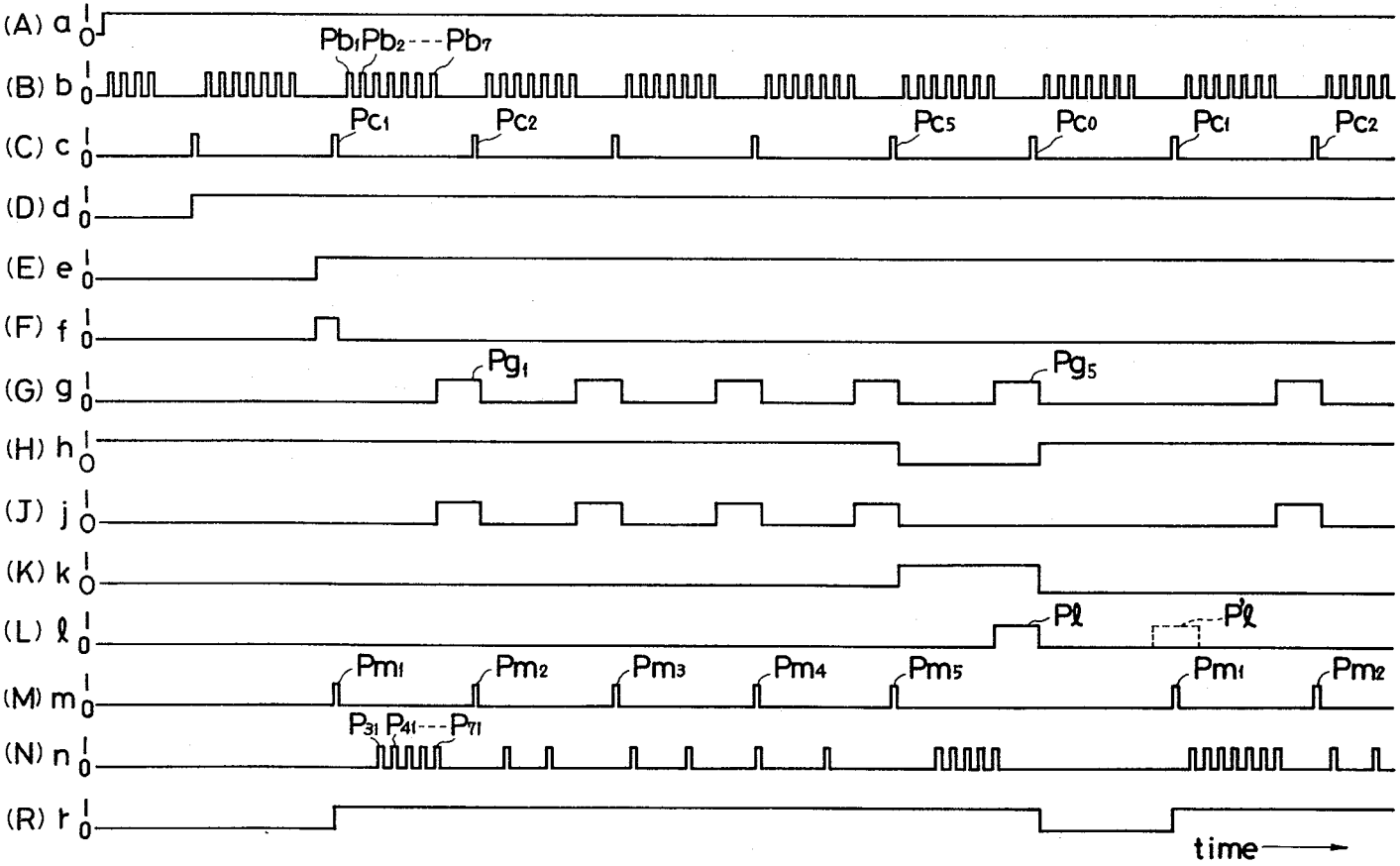
FIG. 6 is a time chart of the operation of the driving control circuit.

On the other hand, the characters such as letters, numerals, symbols and the like corresponding to the data transferred from a computer or the like are beforehand memorized in a character generator 30 in the form of a dot matrix pattern. The character generator 30 is adapted to produce pattern signals of the column of the appointed address corresponding to the column address signal S, in accordance with the latter. Since in this state the value counted by the column address counter 32 is zero, the character generator 30 is producing the pattern signal of the first column of the dot matrix pattern of the character corresponding to the transferred data, and the output signals h and k from the column address counter 32 take the logical values of "1" and "0", respectively, as shown in FIGS. 6H and 6K. In this state, the pulse signal $Pc_1$ of the column detect signal c is produced by the detector 26 shown in FIG. 1 and is supplied to the AND gate 36 shown in FIG. 5, so that the AND gate 36 produces a logical output "1". At the same time, the flip-flop 46 is reset by the fall of the pulse $Pc_1$, so that the output f from the flip-flop 46 takes a logical value "0". As a consequence, the AND gate 36 produces as its output m a pulse $Pm_1$ which appoints the first column of the dot matrix pattern, as shown in FIG. 6. As a result, the pattern signal of the first column of the data transmitted to the character generator 30 in FIG. 5 is written in and memorized by the shift register 31, and the flip-flop 47 is set by the rise of the pulse $Pm_1$ to make the flip-flop 47 produce an output r taking the logical value of "1". Then, the detector 25 shown in FIG. 1 produces row detect pulses $Pb_1, P_{b2} \ldots Pb_7$ of the row detect signal, as shown in FIG. 6B. These row detect pulses $Pb_1, Pb_2 \ldots Pb_7$ are supplied to the AND gate 37 of FIG. 5. Since the logical levels of the two input terminals of the AND gate 37 are "1", the row detect pulses $Pb_1$, $Pb_2 \ldots Pb_7$ are allowed to pass through the AND gate 37. Then, the pattern signal which has been written in the shift register 31 is read out from the latter in accordance with the sequence of formation, i.e. the orders of rows, by the row detect pulses $Pb_1, Pb_2 \ldots Pb_7$, and is delivered to one of the input terminals of the AND gate 38.

Simultaneously with the reading out operation stated above, the row detect pulses $Pb_1, Pb_2 \ldots Pb_7$ are delivered to the other input terminal of the AND gate 38 through the delay circuit 43. Therefore, the AND gate 38 produces as its output n driving pulses corresponding to the pattern signals of the first column, at a slight lag of phase relative to the generation of the row detect pulses $Pb_1, Pb_2 \ldots Pb_7$. For instance, assuming here that the data transmitted to the character generator 30 corresponds to a letter "A", the AND gate 38 produces driving pulses $P_{31}, P_{41} \ldots P_{71}$ as shown in FIG. 6N. These driving pulses $P_{31}, P_{32} \ldots P_{71}$ are so intended that they are produced when any one of the projections 3 of the platen 1 rotating continuously in the direction of the arrow in FIG. 2 is positioned at positions of third row, fourth row . . . seventh row ahead of the striking member 11 of the printing hammer 8 as viewed in FIG. 7. The striking member 11, which is inclined at an angle $\theta$, is continuously moving in the direction of the arrow as viewed in FIG. 7, by the scanning operation of the printing head 4. Therefore, when driving pulses $P_{31}, P_{41}, \ldots P_{71}$ are produced, the projection 3 and the striking member 11 successively cross each other on the third, fourth . . . seventh rows of the first column.

Referring to FIG. 5, as the AND gate 38 produces the driving pulses $P_{31}, P_{41} \ldots P_{71}$ as stated above, the driver circuit 34 is activated by respective driving pulses $P_{31}, P_{41}, \ldots P_{71}$, so that pulse-like driving currents are supplied to the moving coil 15. The moving coil 15 interacts magnetically with the magnetic flux in the gap between the outer magnetic pole 12 and the inner magnetic pole 14 which are magnetized by the permanent magnet 13, and is made to displace to the left as a result of the magnetic interaction. As a consequence, the hammer member 8 is displaced to the left overcoming the force of the leaf spring 10, and the striking member 11 instantaneously collides with the projection 3 of the rotating platen 1, so that the dot of the first column of the letter "A" is formed on the recording paper 17 at the position where the projection 3 and the striking member 11 cross and collide with each other, as shown in FIG. 7.

The description of the printing operation is suspended here, and an explanation will be made as to why the striking member 11 of the printing hammer 8 is inclined. As has been described already, the striking member 11 of the printing hammer 8 operates while it is being moved to the right on the paper as viewed in FIG. 7. Assuming here that the striking member 11 crosses the projection 3 at a right angle, the position of crossing of the projection 3 and the striking member 11 is shifted gradually downwardly in accordance with the rotation of the projection 3 and, at the same time, deviated slightly to the right in accordance with the rightward movement of the striking member 11. As a consequence, the dots in the column direction (vertical direction) are arrayed obliquely and the letter formed on the paper is inclined. Therefore, according to the invention, the striking member 11 is inclined at an angle of about 7° to 8°, so that the dots in the column direction are arrayed along a straight line in the direction of feed of the recording paper. This angle, however, can be modified slightly depending on the design of the letters to be formed. For instance, if the letters are to be formed in an oblique form, the angle $\theta$ may be selected to be much greater.

The description of the printing operation will now be resumed. Referring to FIG. 5, as the aforementioned writing in the shift register 31 by the pulse $Pm_1$ of the AND gate 36 is completed, the pulse $Pm_1$ is counted by the column address counter 32 through the delay circuit 42. Namely, the content of the column address counter 32 is stepped by one, so that the character generator 30 produces the pattern signals for the second column. The output pulse from the AND gate 37, i.e. the row detect pulses $Pb_1, Pb_2 \ldots Pb_7$ are counted by the counter 35 and, as the counted number reaches 7, i.e. as the dot-forming operation is finished with the column, the output signal g from the counter 35 takes a logical value "1" as shown in FIG. 6G. At this time, the output signal h of the column address counter 32, which is the input signal to one input terminal of the AND gate 40, is held at a logical level "1", so that the output signal j from the AND gate 40 takes a logical level "1" and is supplied to the AND gate 36 via the OR gate 41. The AND gate 36 produces, as shown in FIG. 6M, a pulse $Pm_2$ which appoints the second column of the dot matrix, and the counter 35 is reset through the action of the delay circuit 44. Then, the dots of the second column are formed in the same manner as that described before. Namely, the formation of the dots of the second column is performed by the cooperation between the striking member 11 and the projection next to the projection 3 used in the formation of dots of the first column. This operation is repeated to form dots of the third, fourth and fifth columns, to complete the formation of the letter by a seven row five column dot matrix as shown in FIG. 7.

Referring again to FIG. 5, as the column address counter 32 counts up to 5 (five), the output signals h and k therefrom are inverted to take logical levels of "0" and "1", respectively. As a consequence, the output pulse $Pg_5$ of the counter 35 after printing operation for the fifth column makes the AND gate 39 produce an output pulse Pl as shown in FIG. 6L. The column address counter 32 and the flip-flop 47 are reset by the fall of this output pulse Pl. As a consequence, the output signals h and k from the column address counter 32 resume the logical levels "1" and "0", so that the output signal r from the flip-flop 47 takes the logical level "0". Also, the above-mentioned pulse Pl is delayed by the delay circuit 45 to become a pulse Pl' as shown by broken line. This delayed pulse is supplied to the AND gate 36 through the OR gate 41. Therefore, if the AND gate receives a column detect pulse $Pc_0$ after completion of printing of a letter, the AND gate 36 does not produce any pulse as will be seen in FIG. 6M, but produces the output pulse $Pm_1$ when the next column detect pulse $Pc_1$ is received. Namely, the next character is printed after formation of a vacant space corresponding to one dot column, as will be seen from FIG. 7.

The printing hammer 8 is driven at a high frequency of 1800 Hz or higher when the dots are continuously formed, so that the response vibration frequency approximates the resonance frequency of the leaf spring 10.

Also, the column detect signal c may be produced by making use of the row detect signal b, by means of a pure electric circuit which acts in place of the combination of the slit disc 24 and the detector 26. For instance, the pulse distance between the successive pulses $Pb_1, Pb_2 \ldots Pb_7$ are detected by a timer or like means, so that the above-stated column detect pulse Pc is produced pure-electrically between the pulses $Pb_7$ and $Pb_1$, when a long pulse interval is detected.

The practical construction of the printing hammer 8 and the electromagnetic driving device 9 can be modified without departing from the scope of the claim.

Hereinafter, a description will be made as to a second embodiment of the invention in which the design of the electromagnetic driving device 9 is changed.

Figure 8:
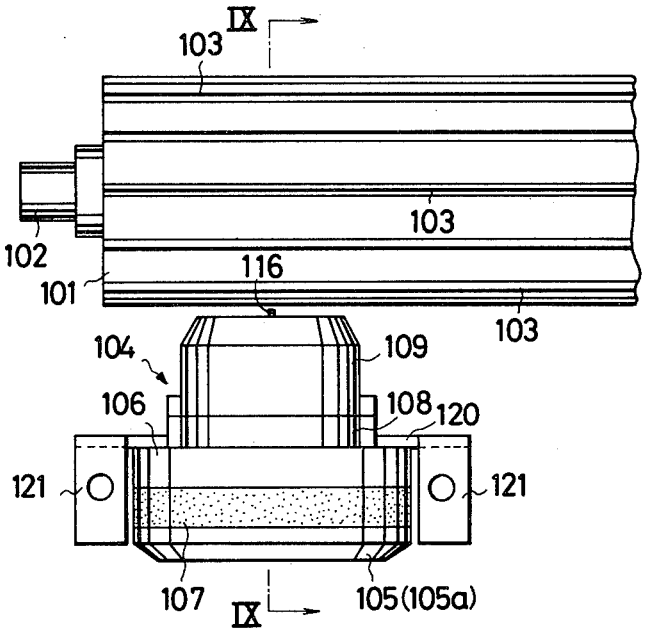
FIG. 8 is a plan view of an essential part of a second embodiment of the invention.
Figure 9:
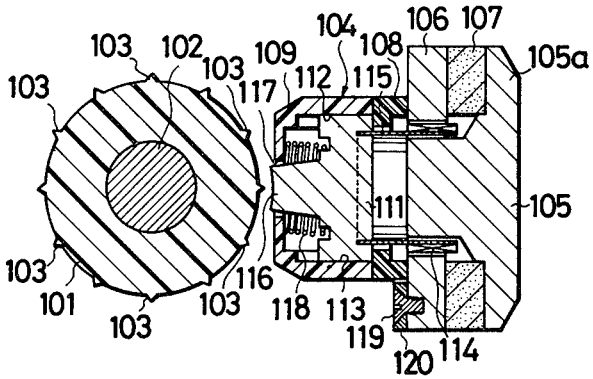
FIG. 9 is a sectional view taken along the line IX—IX of FIG. 8.
Figure 10:
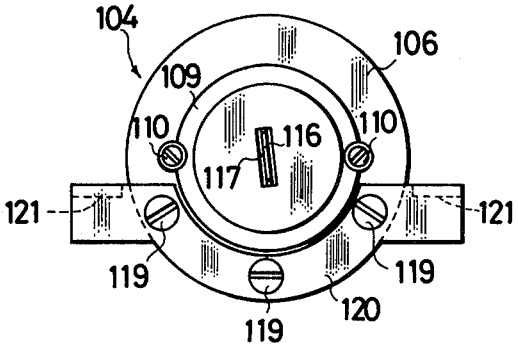
FIG. 10 is a front elevational view of a printing head of the second embodiment.

Referring to FIGS. 8,9 and 10, reference numerals 101,102 and 103 denote a platen, platen shaft and projection which are substantially the same as those of the first embodiment. In this embodiment, however, the printing head 4 is constructed as shown below. A columnar inner magnetic pole 105 is provided at its rear side with a radially projecting disc portion 105*a*. A doughnut-shaped permanent magnet 107 is clamped between the disc portion 105*a* and the outer magnetic pole 106. These members are adhered at their juncture surfaces by means of an adhesive. To the front side of the outer magnetic pole 106, a non-magnetic spacer ring 108 and a cover 109 attached by means of screws 110,110 are as shown in FIG. 10. The cover 109 has a hollow body in which a plate-shaped printing hammer 111 is mounted for free sliding movement along guide grooves 112,113 which are formed integrally with the cover 109. A tubular bobbin 115 around which a moving coil 114 is wound is directly attached to the rear end of the printing hammer 111 and is disposed in the magnetic gap between the inner magnetic pole 105 and the outer magnetic pole 106. Furthermore, the printing hammer 111 is provided with a striking member 116 projecting forwardly therefrom. This striking member 116 corresponds to the striking member 11 of the first embodiment, and extends through the open window 117 formed in the front wall of the cover 109 so as to oppose the projection 103 of the platen 101 in a crossing manner as in the case of the first embodiment. The printing hammer 111 is biased rearwardly by means of a coil spring 118 which is disposed in the cover 109, so that the printing hammer 111 is slightly pressed against the front surface of the spacer ring 108 so as to rest at this position. The printing head 104 is provided with a printing head holder 120 which is secured to the lower part of the outer magnetic pole 106 by means of screws 119. Wing portions 121,121 are formed by bending this holder 120, and extend at both outsides of the inner magnetic pole 105, outer magnetic pole 106 and the permanent magnet 107. The printing head 104 is carried by a carriage (not shown) through a holder 120, and is adapted to scan in the axial direction of the platen 101 by means of a pulse motor (not shown) or the like. Although not shown, the recording paper and the ink ribbon are made to pass through the gap between the striking member 116 of the printing head 104 and the platen 101, as in the case of the first embodiment. The printing operation is substantially identical to that in the first embodiment.

Figure 12:
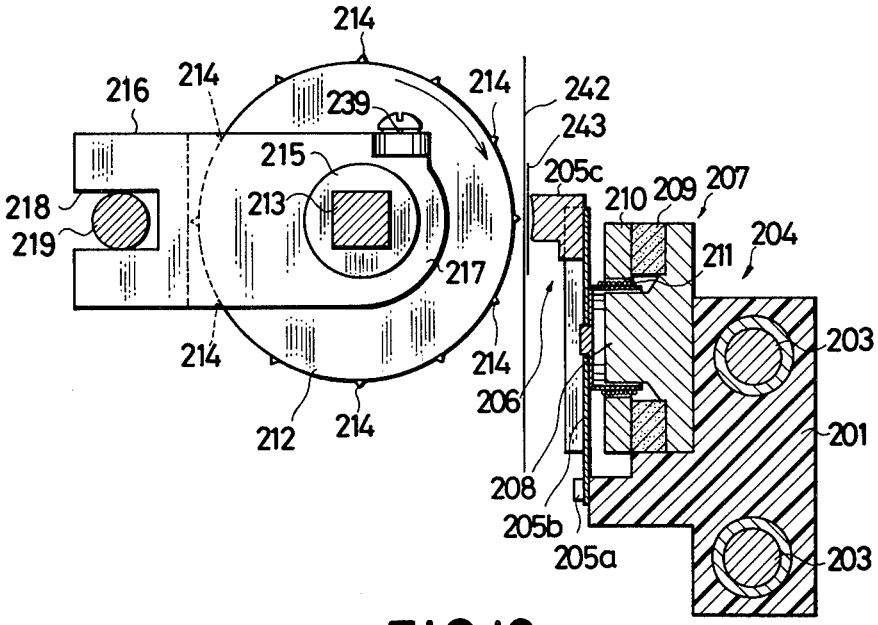
FIG. 12 is an enlarged sectional view taken along the line XII—XII of FIG. 11.
Figure 13:
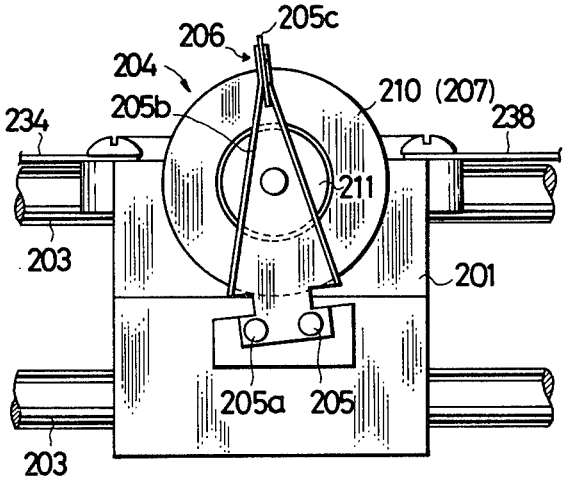
FIG. 13 is an enlarged front elevational view of a printing head incorporated in the third embodiment.

A third embodiment of the invention will be described hereinunder with reference to FIGS. 11,12 and 13.

A carriage 201 made of a non-magnetic light material is slidably supported by guide shafts 203,203 which are fixed to side plates 202 one of which is omitted from the drawings. A printing head 204 attached to the carriage 201 includes a printing hammer 206 and an electromagnetic driving device for driving the printing hammer 206. The printing hammer 206 is constituted by a cantilevered leaf spring 205*b* having a triangular form and cantilevered at its lower end by the carriage 201 through a pin 205*a*, and a striking member 205*c* clamped by the free end of the leaf spring 205*b*. The electromagnetic driving device 207 is constituted by an inner magnetic pole 208 fixed to the carriage 201, a permanent magnet 209 fixed to the rear disc portion of the inner magnetic pole 208, an outer magnetic pole 210 fixed to the permanent magnet 209 and a moving coil 211 disposed in the magnetic gap between the magnetic poles 208,210 and fixed to the leaf spring 205. Thus, the printing head 204 has a construction substantially identical to that of the first embodiment. However, in this third embodiment, the platen 212 has the following specific features. Namely, the platen 212 positioned to oppose the printing head 204 has a short axial length irrespective of the number of characters to be printed, i.e., the axial length of the platen is substantially equal to the width of one character. In this embodiment, the platen 212 has a length which is so small as to permit the formation of only one character. The platen 212 is slidably fitted to the platen shaft 213, the platen shaft 213 being rotatably supported by the side plates 202. Furthermore, the platen 212 is adapted to rotate unitarily with the platen shaft 213 because the latter has a non-circular (rectangular in the illustrated case) cross-section. The platen 212 is provided on the outer peripheral surface thereof with a plurality of (12 as in the case of preceding embodiments) linear projections 214 formed unitarily therewith. The platen 212 is clamped between fork-shaped arm portions 217, 217 of the carrier 216 and have side sleeve portions 215,215 rotatably carried by arm portions 217,217. The carrier 216 is slidable to the left and right but cannot rotate around the sleeve portions 215,215 because a support shaft 219 fixed to the side plates 202 is fittingly received by the notch 218 formed in a rear portion of the carrier 216.

Figure 11:
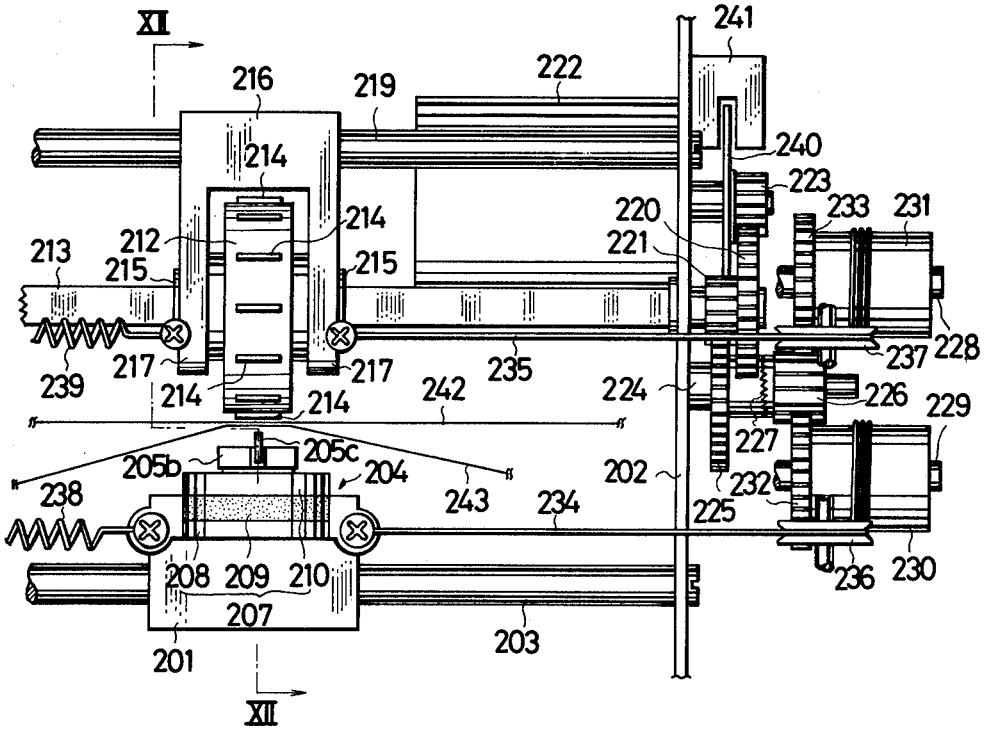
FIG. 11 is a schematic plan view of a third embodiment of the invention.

Referring to FIG. 11, a gear 220 and a pinion 221 are fixed to the end of the platen shaft 213 projecting rightwardly from the side plate 202. The gear 220 meshes with a pinion 223 fixed on a shaft of a driving motor 222. A gear 225 meshing with the pinion 221 is rotatably mounted on a shaft 224 which is fixed to the side plate 202. The shaft 224 carries also a pinion 226 for free rotational and axial sliding movements. The gear 225 and the pinion 226 are operatively connected to each other through clutch gears 227 which are formed integrally with respective gears. The clutch gears 227 are adapted to be brought into and out of engagement with each other by means of an electromagentic plunger which is not shown. The shaft 228 and the shaft 229 are fixed to the side plates 202. A winding drum 230 for the printing head 204 and a winding drum 231 for the platen 212 are rotatably carried by shafts 228 and 229, respectively. Gears 232,233 formed integrally with the drums 230,231 are in engagement with the pinion 226. Pulling ropes 234,235 are connected to the carriage 201 of the printing head 204 and to the carrier 216 of the platen 212. These ropes 234,235 are wound round respective drums 230,231 via pulleys 236,237.

These drums 230,231 are adapted to be driven in opposite directions. However, since the ropes 234,235 are wound round respective drums 230,231 in opposite winding directions, the winding up operation and the unlacing operation of these drums are made in synchronism.

Further, return springs 238,239 are connected to the left side parts of the carriage 201 and carrier 216. The pinion 223 is provided with a slit disc 240 corresponding to the slit disc 21 of the first embodiment. The outer peripheral portion of the slit disc 240 is received by an opening of a detector 241 and the synchronization of the printing operation similar to that made in the first embodiment is achieved by making use of the detection signal provided by the detector 241. A recording paper 242 and an ink ribbon 243 are disposed between the printing head 204 and the platen 212, as in the case of the first embodiment.

When the carriage 201 and the carrier 216 are at the start position, i.e. at the left end of their strokes, gears 232,233 are driven through the pinion 223, gear 220, pinion 221, gear 225, clutch gear 227 and the pinion 226, as the driving motor 222 is started. As a consequence, the drums 230,231 are rotated. Therefore, the ropes 234,235 are wound up by the associated drums 230,231 so that the carriage 201 and the carrier 216 are moved from the start position to the right for the scanning operation, while maintaining a constant positional relationship therebetween, at a predetermined speed of movement.

In this state, the platen 212 clamped by the carrier 216 is moved to the right together with the latter and, at the same time, continuously rotated in the clockwise direction as viewed in FIG. 2 by means of the platen shaft 213. Then, the printing operation is performed in the same manner as the first embodiment, during synchronized movement of the printing head 204 and the platen 212. As the printing in one line is completed, the return signal is supplied to the plunger of the clutch gear 227. Then, the clutch gear 227 is disengaged so that the carriage 201 and the carrier 216 are reset to the initial start position by the forces of the return springs 238, 239.

In this third embodiment, the projection 214 of the platen 212 is required to have a length which may be so small as to be sufficient to cross the striking member **205*c*. However, practically, it is recommended that the projection 214 has a length substantially corresponding to the width of one character. It is also possible to employ a screw type driving mechanism which is well known, for the scanning driving of the carriage 201 and the carrier 216. It is also possible to use independent driving sources for the carriage 201 and the carrier 216**.

In the first, second and the third embodiment as described above, the platen 1,101,212 may be driven in the reverse direction. In such a case, the striking members **11,116,205*c* are modified to incline in the opposite direction to that of the illustrated embodiments. It is also possible to form the striking members 11 and 205*c* of the first and the third embodiments integrally with the leaf springs 10 and 205*b***, respectively.

As described above in the impact type dot printer of the invention, it is possible to form letters, numerals, symbols, graphs and pictures by a single printing hammer. At the same time, the size and weight of the printing head can be reduced because it is comprised of a reduced number of parts, so that the printing head can be driven even by a lower power driving motor. Furthermore, since the inertia of the printing hammer is diminished, it is possible to drive the hammer at a high speed and, at the same time, the power consumption is reduced. The operation speed of the printing hammer is further increased and the durability is further increased, when the printing hammer is constructed by a cantilevered leaf spring and a striking member attached to the free end of the leaf spring, because in such an arrangement the is no frictional part. Also, when the platen is designed to be moved together with the printing head, the length of the platen is minimized to facilitate its production, and the adverse affect of the deformation or deflection of the platen on the printing quality is completely avoided. Moreover, the number of characters printable in one line is never limited by the length of the platen so that the maximum printable number of characters per line can be increased as desired without substantial limitation. In addition, the printer of the invention can be assembled easily and can be produced at a low cost.

What is claimed is:

1. In an impact type dot printer, the combination comprising: a rotary platen having on its outer peripheral surface a plurality of projections extending substantially parallel to the axis of said rotary platen; a printing head movable in a direction parallel to the axis of said rotary platen, said printing head including a single actuatable printing hammer; and electromagnetic driving means for driving said printing hammer during a printing operation to collide with one of said projections, said electromagnetic driving means comprising a center yoke, an outer yoke arranged to surround said center yoke, a permanent magnet for magnetizing said center and outer yokes, an annular magnetic air gap formed between said center and outer yokes, and a cylindrical moving coil disposed in said annular magnetic air gap and energizable for interacting with said magnetized yokes to actuate said printing hammer; said printing hammer comprising a cantilevered leaf spring carrying thereon said moving coil and having a striking member connected at the free end thereof.

2. In an impact type dot printer as claimed in claim 1; wherein said rotary platen has an axial length substantially equal to the width of a character to be printed, and further comprising means for mounting said rotary platen together with said printing head for movement in a direction parallel to the axis of said rotary platen.

3. In an impact type dot printer as claimed in claim 1; wherein said striking member is connected to the free end of the cantilevered leaf spring so as to oppose the projections of said rotary platen substantially in a crossing manner.

* * * * *